US008885446B2

(12) United States Patent
Matsuzaki

(10) Patent No.: US 8,885,446 B2
(45) Date of Patent: Nov. 11, 2014

(54) ELECTRONIC TIMEPIECE

(71) Applicant: Seiko Epson Corporation, Tokyo (JP)

(72) Inventor: Jun Matsuzaki, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/023,718

(22) Filed: Sep. 11, 2013

(65) Prior Publication Data

US 2014/0086022 A1 Mar. 27, 2014

(30) Foreign Application Priority Data

Sep. 24, 2012 (JP) ..... 2012-209259

(51) Int. Cl.

| | |
|---|---|
| ***G04C 3/00*** | (2006.01) |
| ***G04R 20/04*** | (2013.01) |
| ***G04R 60/10*** | (2013.01) |
| ***G04R 60/12*** | (2013.01) |
| *G04C 10/02* | (2006.01) |

(52) U.S. Cl.

CPC ..... *G04R 60/10* (2013.01); *G04R 20/04* (2013.01); *G04C 10/02* (2013.01); *G04R 60/12* (2013.01)

USPC ..... 368/204; 368/47

(58) Field of Classification Search

USPC ..... 368/13–14, 46–47, 203–204

See application file for complete search history.

(56) References Cited

U.S. PATENT DOCUMENTS

| | | | | |
|---|---|---|---|---|
| 6,219,302 | B1 * | 4/2001 | Tanoguchi et al. | 368/47 |
| 7,394,726 | B2 * | 7/2008 | O'Neill et al. | 368/21 |
| 7,720,452 | B2 * | 5/2010 | Miyahara et al. | 455/191.1 |
| 7,839,725 | B2 * | 11/2010 | Watanabe et al. | 368/47 |
| 7,903,501 | B2 * | 3/2011 | Fujisawa | 368/47 |
| 8,570,838 | B2 * | 10/2013 | Fujisawa | 368/47 |

FOREIGN PATENT DOCUMENTS

JP 2007-101233 A 4/2007

* cited by examiner

*Primary Examiner* — Sean Kayes

(74) *Attorney, Agent, or Firm* — Harness, Dickey & Pierce, P.L.C.

(57) ABSTRACT

An electronic timepiece has a case of which at least part is conductive; a clock chip that keeps and displays time on a time display means; a receiver chip that receives a radio signal through a GPS antenna; a storage battery; a timekeeping voltage conversion unit that converts output voltage from the storage battery to drive voltage for the clock chip; and a receiver voltage conversion unit that converts output voltage from the storage battery to drive voltage for the receiver chip. The output terminal of the timekeeping voltage conversion unit is connected to the clock chip and the case, and the output terminal of the receiver voltage conversion unit is connected to the receiver chip.

4 Claims, 2 Drawing Sheets

ELECTRONIC TIMEPIECE

BACKGROUND

1. Technical Field

The present invention relates to an electronic timepiece, and relates more particularly to an electronic timepiece that can receive radio signals.

2. Related Art

Electronic timepieces having a timekeeping unit that keeps and displays time, and a heavy load system that has high power consumption compared with the timekeeping unit, are known from the literature. The electronic timepiece disclosed in Japanese Unexamined Patent Appl. Pub. JP-A-2007-101233, for example, has an electronic clock circuit as the timekeeping unit, and a keyless entry circuit as the heavy load system. In addition to a timekeeping unit, other electronic timepieces have a receiver circuit to receive radio signals such as time standard signals or satellite signals transmitted from GPS (Global Positioning System) satellites as the heavy load system.

In order to drive the heavy load system and timekeeping unit stably, an electronic timepiece with a heavy load system preferably uses separate power supplies to drive the heavy load system and timekeeping unit. More particularly, the receiver unit that receives radio signals is preferably driven using a stable voltage in order to improve reception sensitivity.

The electronic timepiece disclosed in JP-A-2007-101233 therefore has two batteries, a battery for the clock control circuit and a battery for the keyless entry circuit.

However, providing two batteries in an electronic timepiece increases the size of the electronic timepiece.

SUMMARY

The present invention is directed to reducing the size of an electronic timepiece that has a receiver circuit to receive radio signals while also improving reception sensitivity.

An electronic timepiece according to one aspect of the invention has a frame of which at least part is conductive; a timekeeping unit that keeps and displays time; a receiver unit that receives a radio signal; a battery; a first voltage conversion unit that converts output voltage from the battery to a first drive voltage; and a second voltage conversion unit that converts output voltage from the battery to a second drive voltage. The output terminal of the first voltage conversion unit is connected to the timekeeping unit and the frame, and the output terminal of the second voltage conversion unit is connected to the receiver unit.

The first drive voltage and the second drive voltage may be the same voltage or different voltages. The first drive voltage is preferably set to a voltage for driving the timekeeping unit (clock chip) in a common quartz timepiece. The output terminal of the first voltage conversion unit is connected to the frame. As a result, when the frame has a part that is made from a non-conductive material, the output terminal of the first voltage conversion unit is electrically connected to the part of the frame made from a conductive material.

By using a first voltage conversion unit and a second voltage conversion unit, this aspect of the invention can stably drive the timekeeping unit and the receiver unit using the voltage set by the respective voltage conversion units even when there is only one battery. Separate batteries for the timekeeping unit and receiver unit are therefore not needed, and the electronic timepiece can be made small.

The potential of the frame can also be held at the same voltage as the first drive voltage used for the timekeeping unit because the output terminal of the first voltage conversion unit is conductive to the frame (case). As a result, the system for detecting operation of an input unit, such as a button or pusher, disposed to the frame can be the same as used in a common quartz timepiece. More specifically, because the potential of the timekeeping unit and the frame is the same as the first drive voltage, the timekeeping unit and input unit can be the same as used in a common quartz timepiece.

The output terminal of the first voltage conversion unit is also conductive to the frame in the invention. The output terminal of the second voltage conversion unit therefore does not need to be conductive to the frame. Therefore, while the output voltage of the first voltage conversion unit tends to fluctuate due to external factors such as contact between the case and the user's skin (body), the output voltage of the second voltage conversion unit is not affected by such external factors and the receiver unit can therefore receive a stable voltage supply. The receiver unit in this aspect of the invention can therefore detect radio signals stably, and reception sensitivity can be improved.

In an electronic timepiece according to another aspect of the invention, the radio signal received by the receiver unit is a satellite signal transmitted from a positioning information satellite.

By receiving satellite signals as the radio signals, this aspect of the invention can acquire time information and positioning information for calculating the current location, adjust the internal time using the acquired time information and the current location information calculated from the positioning information, and display the time at the current location.

The satellite signals can also be received anywhere on Earth from positioning information satellites. The electronic timepiece according to the invention can therefore receive satellite signals and display the time at the current location anywhere on Earth.

In an electronic timepiece according to another aspect of the invention, the battery is preferably a lithium ion battery.

By using a lithium ion battery, which is a storage battery, as the battery, this aspect of the invention enables charging the battery. An electronic timepiece that does not require replacing the battery can therefore be provided by incorporating a generator that produces power by a rotor, a solar cell, or other type of generating means in the electronic timepiece.

A lithium ion battery has a high energy density, and enables using a small, high capacity battery. As a result, the receiver unit, which consumes more drive current than the timekeeping unit, can also be driven stably.

An electronic timepiece according to another aspect of the invention preferably also has a capacitor having one end connected to a line that is conductive to the negative terminal of the battery and the receiver unit, and the other end connected to the frame.

In this aspect of the invention the capacitor functions as a high frequency ground that removes high frequency noise caused by the radio signal, which is a high frequency electromagnetic wave, received by the receiver unit. The receiver unit can therefore detect radio waves more stably.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Electronic Timepiece Construction

Figure 1:
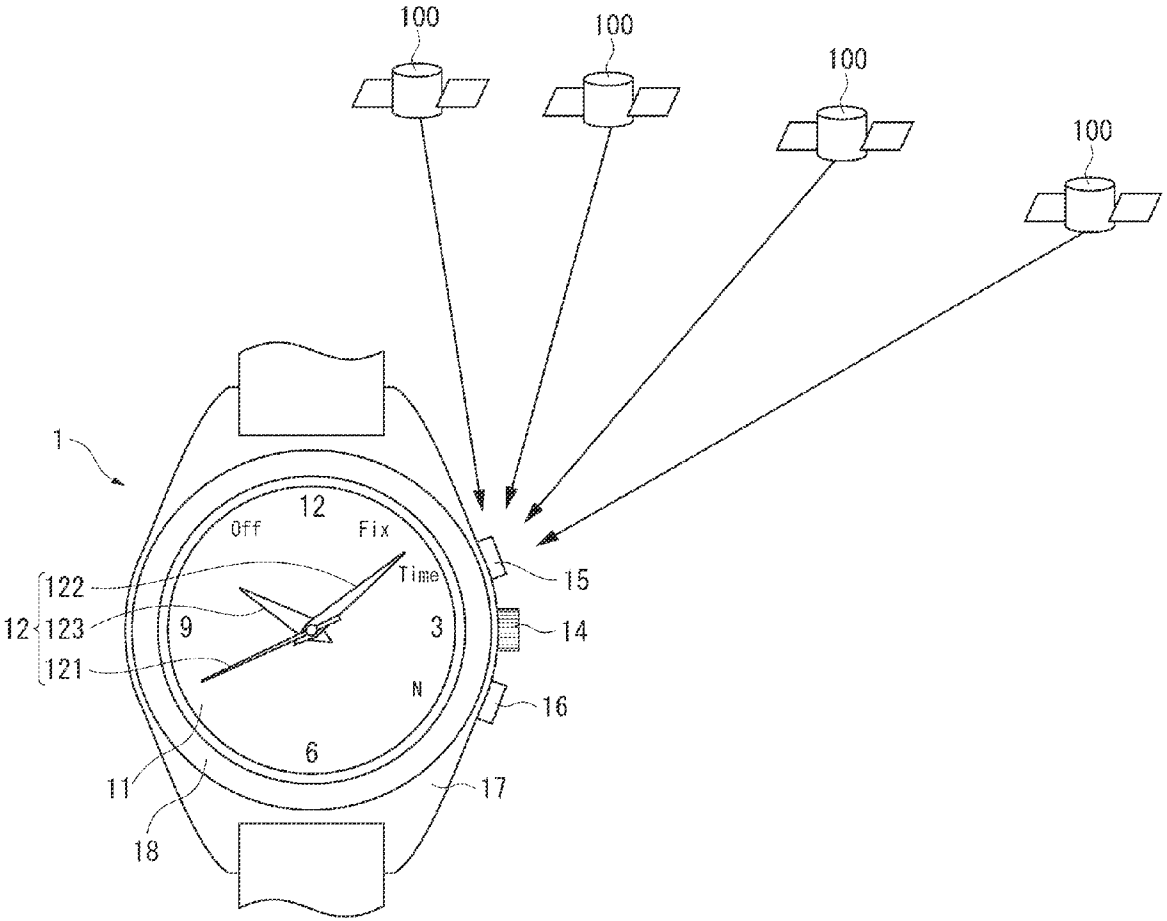
FIG. 1 is a plan view showing an electronic timepiece according to a preferred embodiment of the invention.

As shown in FIG. 1, an electronic timepiece 1 according to this embodiment of the invention receives satellite signals from a plurality of GPS satellites 100 (positioning information satellites) that orbit the Earth on specific known orbits. The electronic timepiece 1 receives satellite signals from at least one GPS satellite 100 to acquire time information, and receives satellite signals from at least three GPS satellites 100 to acquire positioning information. Multiple GPS satellites 100 are in orbit. There are currently approximately 30 GPS satellites 100 in the GPS constellation.

The electronic timepiece 1 in this embodiment is a wristwatch that is worn on the user's wrist, has a dial 11 and hands 12, and keeps and displays the time.

The greater part of the dial 11 is made from a non-metallic material, such as plastic or glass, that is transparent to light and microwaves in the 1.5 GHz band.

The hands 12 are disposed on the exposed side of the dial 11. The hands 12 include a second hand 121, minute hand 122, and hour hand 123 that rotate on a center pivot 13.

The electronic timepiece 1 has a crown 14 and pushers 15, 16 as input units. The electronic timepiece 1 executes specific processes according to operation of the crown 14 and pushers 15, 16. For example, when the crown 14 is operated, a manual adjustment process that adjusts the displayed time is executed as controlled by the crown 14. If the one pusher 15 is pressed for a long time (such as 3 seconds or more), a reception process is executed to receive satellite signals (manual reception mode). If the other pusher 16 is pressed, a process that changes the reception mode is executed (selecting the timekeeping mode, positioning mode, or auto-reception cancellation mode). If the positioning mode is selected as a result of pressing the pusher 16 and changing the reception mode, the second hand 121 moves to the FIX position (at 1:00). If the timekeeping mode is selected, the second hand 121 moves to the TIME position (at 2:00). If the auto-reception cancellation mode (reception OFF mode) is selected, the second hand 121 moves to the OFF position (at 11:00). The user can therefore easily know which mode is set.

If pusher 15 is pressed for a short time (such as less than 3 seconds), a result display process that displays the result of the last reception process is executed. More specifically, if reception was successful in the positioning mode, the second hand 121 goes to the FIX (1:00) position. If reception was successful in the timekeeping mode, the second hand 121 goes to the TIME (2:00) position. If reception fails, the second hand 121 goes to the N position (at 4:00).

These indications are also made by the second hand 121 during reception. In the positioning mode, the second hand 121 goes to the FIX (1:00) position. In the timekeeping mode, the second hand 121 goes to the TIME (2:00) position. If a GPS satellite 100 cannot be locked onto, the second hand 121 goes to the N position (at 4:00).

Figure 2:
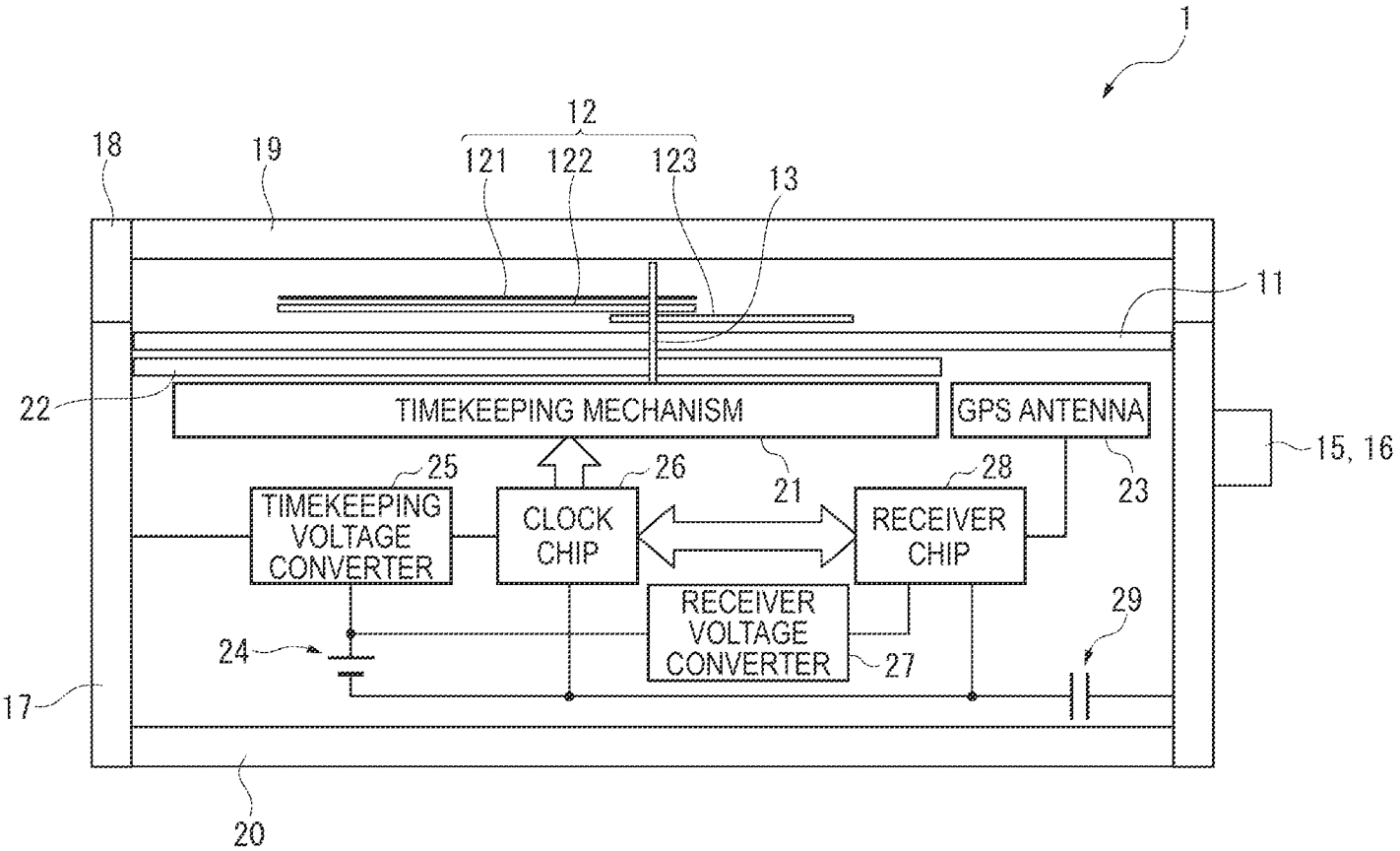
FIG. 2 shows the basic configuration of the electronic timepiece.

As shown in FIG. 2, the electronic timepiece 1 has a case 17 made of stainless steel (SUS), titanium, or other metal. This case 17 is also referred to as the frame herein.

The case 17 is substantially cylindrical. A crystal 19 is attached to the opening on the face side of the case 17 with a bezel 18. The bezel 18 is made of ceramic or other non-metallic material to improve satellite signal reception performance. A back cover 20 is attached to the opening on the back side of the case 17.

A timekeeping mechanism 21, solar cell 22, GPS antenna 23, storage battery 24, and circuits for driving the electronic timepiece 1 are disposed inside the case 17.

The timekeeping mechanism 21 includes a stepper motor and wheel train. The stepper motor includes a motor coil, stator, and rotor, and drives the hands 12 through the wheel train and center pivot 13.

The solar cell 22 is disposed between the timekeeping mechanism 21 and dial 11, or more specifically on the back side of (behind) the dial 11. The solar cell 22 is a photovoltaic device that produces power by converting light energy to electrical energy. The solar cell 22 has an electrode for outputting the generated power. Because the greater part of the dial 11 is made from a material through which light passes easily, the solar cell 22 can receive light through the crystal 19 and dial 11 and produce power.

The GPS antenna 23 receives microwave signals in the 1.5 GHz band. The GPS antenna 23 is also disposed behind the dial 11. The part of the dial 11 above the GPS antenna 23 in the direction perpendicular to the dial 11 is made of a material through which microwaves in the 1.5 GHz band can pass easily (such as a non-metallic material with low conductivity and permeability). The solar cell 22 with electrode is not between the GPS antenna 23 and the dial 11. The GPS antenna 23 can therefore receive satellite signals passing through the crystal 19 and dial 11.

The GPS antenna 23 can be a loop antenna, patch antenna (microstrip antenna), helical antenna, chip antenna, or an inverted-F antenna, for example.

The storage battery 24 is a battery according to the invention, and is the power supply of the electronic timepiece 1. The electronic timepiece 1 has a charging control circuit that charges the storage battery 24 with power produced by the solar cell 22, and the storage battery 24 stores the power generated by the solar cell 22.

A lithium ion battery that is suitable for mobile devices is used as the storage battery 24 in this embodiment of the invention, but a lithium polymer battery or other type of storage battery can be used. A storage device other than a storage battery (such as a capacitive device) can also be used.

Because this embodiment uses a lithium ion battery as the storage battery 24, a battery with greater capacity than a button battery commonly used in quartz timepieces can be used.

The electronic timepiece 1 according to this embodiment of the invention receives a satellite signal through the GPS antenna 23, and adjusts the time kept by the electronic timepiece 1 based on the satellite signal. The electronic timepiece 1 therefore also has a receiver chip 28 described below and adjusts the time based on the received satellite signal. Driving this receiver chip 28 generally requires more current than driving the clock chip 26 described below. For example, while a few milliamperes is sufficient to drive the clock chip 26, driving the receiver chip 28 requires several ten milliamperes of current. The receiver chip 28 can therefore be driven stably by using a high capacity battery.

This high capacity storage battery 24 normally has an output voltage (such as 3.7 V) that is higher than the drive voltage (such as 1.5 V) of the clock chip 26.

Circuit Unit Configuration

As shown in FIG. 2, the circuit unit includes the storage battery 24, a timekeeping voltage converter 25 as the first voltage conversion unit of the invention, the clock chip 26, a receiver voltage converter 27 as the second voltage conversion unit of the invention, the receiver chip 28, and a capacitor 29. This circuit unit is mounted on a circuit board not shown that is disposed on the back side of the timekeeping mechanism 21. The movement of the electronic timepiece 1 is rendered by the timekeeping mechanism 21 and circuit board.

The input terminal of the timekeeping voltage converter 25 is connected to positive terminal of the storage battery 24, and the output terminal is connected to the clock chip 26 and case 17. The timekeeping voltage converter 25 converts the output voltage of the storage battery 24 to the drive voltage (first drive voltage) of the clock chip 26, and applies this drive voltage (VDD) to the clock chip 26. Because the output terminal of the timekeeping voltage converter 25 is connected to the case 17, the drive voltage (VDD) is used as the ground voltage, that is, the voltage of the case 17.

The output voltage (battery voltage) of the storage battery 24, which is a lithium ion battery, is normally approximately 3.7 V. The output voltage of a button battery typically used in a quartz timepiece is normally approximately 1.5 V. The clock chip 26 is the same type used in a quartz timepiece, and is driven at 1.5 V. As a result, the timekeeping voltage converter 25 converts the battery voltage (such as 3.7 V) of the storage battery 24 to the first drive voltage (such as 1.5 V) for driving the clock chip 26.

The clock chip 26 is connected to the timekeeping voltage converter 25 and the negative terminal (VSS) of the storage battery 24, and is driven by the first drive voltage output by the timekeeping voltage converter 25.

The clock chip 26 executes a timekeeping process keeping the internal time, a process driving the hands 12, and a reception control process.

More specifically, the clock chip 26 keeps the internal time by counting a reference signal generated using a crystal oscillator not shown, and outputs a motor drive pulse to the timekeeping mechanism 21 to drive the hands 12 and display the internal time.

When satellite time information contained in the satellite signal is acquired by the receiver chip 28, the clock chip 26 receives this time information from the receiver chip 28 and adjusts the internal time.

To execute the automatic reception mode that acquires satellite time information at a specific time, the clock chip 26 sends a drive signal causing the receiver chip 28 to execute the automatic reception mode when a specific time is reached.

When in the positioning mode, the clock chip 26 also acquires orbit information and other information used to calculate the position in addition to the satellite time information, calculates the current location, and generates location information for the current position. The clock chip 26 also adjusts the internal time using the satellite time information and the positioning information. The clock chip 26 also has a storage unit that stores data for controlling the electronic timepiece 1, including time zone information for calculating the time at the current location from the satellite time information.

The timekeeping unit of the invention is embodied by the dial 11, hands 12, timekeeping mechanism 21, and clock chip 26.

The input terminal of the receiver voltage converter 27 is connected to the positive terminal of the storage battery 24, and the output terminal is connected to the receiver chip 28. The receiver voltage converter 27 converts the battery voltage (such as 3.7 V) to the drive voltage (the second drive voltage of the invention, such as 1.5 V) of the receiver chip 28, and applies the drive voltage to the receiver chip 28.

The low voltage side of the receiver chip 28 is connected to the negative terminal (VSS) of the storage battery 24. This line is also conductive to the case 17 through the capacitor 29.

When operating in the timekeeping mode, the receiver chip 28 gets the satellite time information from the satellite signal received by the GPS antenna 23, and passes the acquired satellite time information to the clock chip 26.

When operating in the positioning mode, the receiver chip 28 gets the satellite time information and information for calculating the current location from the satellite signal received by the GPS antenna 23, and outputs the acquired information to the clock chip 26.

The receiver unit of the invention is therefore embodied by the GPS antenna 23 and receiver chip 28.

The circuit unit also includes an operation detection circuit that detects operation of the pushers 15, 16. When a pusher is operated, the operation detection circuit detects the change in voltage from VDD (high voltage) to VSS (low voltage). The clock chip 26 detects a pusher was operated and applies control as described above based on the voltage change detected by the operation detection circuit.

Operational Effect of the Electronic Timepiece

The effect of an electronic timepiece 1 according to this embodiment of the invention is described below.

The electronic timepiece 1 according to this embodiment of the invention has a timekeeping voltage converter 25 that converts the output voltage of the storage battery 24 to a first drive voltage, and a receiver voltage converter 27 that converts the output voltage of the storage battery 24 to a second drive voltage, drives the clock chip 26 of the timekeeping unit with the first drive voltage, and drives the receiver chip 28 with the second drive voltage. As a result, the timekeeping unit and receiver unit can be driven using one storage battery 24, there is no need to provide individual batteries for the timekeeping unit and receiver unit, and a small electronic timepiece 1 can therefore be easily achieved.

The output terminal of the timekeeping voltage converter 25 is connected to the case 17, and the first drive voltage is used as the ground voltage (case potential) in this embodiment. Connecting the receiver voltage converter 27 to the case 17 is therefore not necessary.

The drive voltage of the receiver chip 28 (second drive voltage) will therefore not fluctuate even if the voltage on the output side of the timekeeping voltage converter 25 varies due to external factors such as contact between the frame (case 17) and the body, and the receiver chip 28 can receive a stable power supply.

More specifically, the receiver chip 28 in this embodiment can stably detect radio signals, and can improve reception sensitivity.

Furthermore, because the output terminal of the timekeeping voltage converter 25 is electrically connected to the case 17, the potential of the case 17 can be held at the same voltage, the first drive voltage, as the drive voltage of the clock chip 26. As a result, the operation detection circuit of the input unit such as the pushers 15, 16 disposed to the frame can be the same as used in a common quartz timepiece. More specifically, the operation detection circuit uses a common method for detecting a voltage change from the high voltage (VDD such as 1.5 V) when a pusher 15, 16 is not operated to the low voltage (VSS) when a pusher 15, 16 is operated. A common operation detection circuit can also be used and increased cost can be suppressed in this embodiment because the case 17 is set to the first drive voltage (such as 1.5 V).

Yet further, because the case 17 is conductive (connected) through the capacitor 29 to the low voltage side (VSS) of the receiver chip 28, the capacitor 29 can be made to function as a high frequency ground, and the antenna sensitivity of the receiver chip 28 can be improved.

Other Embodiments

The invention is not limited to the foregoing embodiment, and can be changed in many ways without departing from the scope of the accompanying claims.

For example, a capacitor 29 that functions as a high frequency ground is disposed in the foregoing embodiment, but the invention is not so limited and a configuration not having a capacitor 29 is also conceivable.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention is also described above using a configuration that receives satellite signals as the radio signals, but the invention is not so limited and configurations that receive standard time signals transmitted from a standard time transmitter are also conceivable.

The receiver unit of the electronic timepiece 1 is also not limited to receiving satellite signals or time standard signals, and configurations that use a Bluetooth (R), Wi-Fi (R), or other radio frequency receiving means are also conceivable. A configuration having a radio signal transmitter function is also conceivable.

The drive voltage of the clock chip 26 and receiver chip 28 is 1.5 V in the foregoing embodiment, but the invention is not so limited. The drive voltage of the clock chip 26 can also differ from the drive voltage of the receiver chip 28.

Furthermore, the foregoing embodiment describes an electronic timepiece having an analog time display means with hands 12 as an example of a time display means embodying the timekeeping unit, but the invention can also be used in an electronic timepiece that displays the time digitally using an LCD device, for example.

The foregoing embodiment also describes a configuration having a solar cell 22 as the charging means that charges the storage battery 24, but the invention is not so limited. For example, the invention can also use a generator that produces power using a rotor as the charging means. Further alternatively, configurations that are charged from an external power source (such as a wall outlet) using a power cord, and configurations that are charged from an external power source by wireless charging using electromagnetic induction, are also conceivable.

The entire case 17 (frame) in the foregoing embodiment is made of a conductive material (metal), but part of the case could be made of a non-conductive material. More specifically, at least part of the frame (case) must be conductive. If part of the frame is made of a non-conductive material, the output terminal of the timekeeping voltage converter 25 is electrically connected and conductive to the part of the frame made of the conductive material.

The electronic timepiece 1 according to the invention is also not limited to a wristwatch, and can be broadly applied in devices having an electronic timepiece function and a receiver function. The invention is particularly well suited to mobile electronic timepieces driven by a storage battery.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2012-209259, filed Sep. 24, 2012 is expressly incorporated by reference herein.

What is claimed is:

1. An electronic timepiece comprising:

a frame of which at least part is conductive;

a timekeeping unit that keeps and displays time;

a receiver unit that receives a radio signal;

a battery;

a first voltage conversion unit that converts output voltage from the battery to a first drive voltage; and a second voltage conversion unit that converts output voltage from the battery to a second drive voltage;

wherein the output terminal of the first voltage conversion unit is connected to the timekeeping unit and the frame, and the output terminal of the second voltage conversion unit is connected to the receiver unit.

2. The electronic timepiece described in claim 1, wherein:

the receiver unit receives a satellite signal transmitted from a positioning information satellite as the radio signal.

3. The electronic timepiece described in claim 1, wherein:

the battery is a lithium ion battery.

4. The electronic timepiece described in claim 1, further comprising:

a capacitor having one end connected to a line that is conductive to the negative terminal of the battery and receiver unit, and the other end connected to the frame.

* * * * *